US005533671A

United States Patent [19]

Baer

[11] Patent Number: 5,533,671

[45] Date of Patent: Jul. 9, 1996

[54] HIGH PRESSURE HOT WATER CHEMICAL WASHER

[75] Inventor: Ronald W. Baer, Denver, Colo.

[73] Assignee: Unique Industries, Inc., Denver, Colo.

[21] Appl. No.: 101,301

[22] Filed: Aug. 3, 1993

[51] Int. Cl.[6] ..... B05B 7/16; B05B 7/26

[52] U.S. Cl. ..... 239/10; 239/67; 239/75; 239/127; 239/131; 239/306; 239/373

[58] Field of Search ..... 239/10, 61, 67, 239/75, 110, 130, 131, 135, 139, 306, 373, 413, 416.2, 423, 426, 526, 527, 530, 127; 417/434; 137/570

[56] References Cited

U.S. PATENT DOCUMENTS

| | | | |
|---|---|---|---|
| D. 239,048 | 3/1976 | Hewett . | |
| 1,007,667 | 11/1911 | Ballard | 239/416.2 X |
| 2,077,257 | 4/1937 | Ofeldt | 239/127 X |
| 2,987,259 | 6/1961 | Lindquist | 239/130 |
| 3,520,643 | 7/1970 | Busse et al. | 417/434 |
| 3,556,402 | 1/1971 | Wolking | 239/130 |
| 3,997,114 | 12/1976 | Hewett . | |
| 4,046,321 | 9/1977 | Hewett . | |
| 4,287,912 | 9/1981 | Hewett . | |
| 4,465,428 | 8/1984 | Lindberg | 417/434 X |
| 4,947,025 | 8/1990 | Alston et al. | 239/130 X |

OTHER PUBLICATIONS

Kem–O–Kleen Chemical Injection Machine Brochure.
Kem–O–Kleen Model K–3007 Brochure.
Kem–O–Kleen Models K–1503, K–2204 Brochure.
Unique Industries, Inc., Kem–O–Kleen Division Advertisement "Time is Money".
Unique Industries, Inc., Kem–O–Kleen Division Advertisement "The Finishing Touch".
Kem–O–Kleen Models C–100–A, C–1503–A, C–3004–A Brochure.

*Primary Examiner*—Andres Kashnikow
*Attorney, Agent, or Firm*—James Creighton Wray

[57] ABSTRACT

A high pressure hot water acid washer is towed to a site on a trailer. A chemical tank and gasoline and diesel fuel tanks are filled. A water supply hose is connected to a water tank. A power cord is connected to a power source. A float valve controls the filling of the water tank. Water flows from the water tank through a Y-type filter to a water pump. A drain withdraws water directly from the water pump. The water pump and a compressor are driven with an engine. Pressurized water flows through a flow switch to a heat exchanger. Upon water flow, the flow switch completes a power circuit to operate a fuel pump with an electric motor. Fuel is pumped from the fuel tank and is atomized and sprayed into the heat exchanger. An ignition coil ignites the fuel. The power circuit is interrupted upon sensing a high temperature in a pressurized water delivery line from the heat exchanger. Pressure of pressurized hot water in the delivery line is controlled with a hot water pressure relief valve. Hot water flows out through a high pressure hot water hose and nozzle. The chemical tank is pressurized with air from the compressor, and chemical flows from the chemical tank. Rate of flow of chemical is controlled with a needle valve. Opening the chemical line with ball valve releases chemical to the fast hot water stream from the nozzle.

5 Claims, 1 Drawing Sheet

HIGH PRESSURE HOT WATER CHEMICAL WASHER

BACKGROUND OF THE INVENTION

This invention is used for high pressure hot water chemical washers in which acids or other chemicals are injected at the nozzles. The high pressure hot water chemical washers are used for many purposes.

The apparatus is used with plain, inexpensive muriatic acid for most masonry cleaning jobs. If special chemicals are specified, the apparatus can use the special chemicals. The apparatus cleans mortar from rough surface brick, Type S mortar, Portland cement spatter, Sarabond, efflorescence, vanadium or manganese. Smoke damage and tar are removed by the present apparatus without leaving stains. The apparatus cleans atmospheric deposits such as dirt, black carbon, rust, green mold and other deposits from masonry, stone or plaster surfaces.

The device is simplified and sturdy.

Underlying technology is described and claimed in U.S. Pat. Nos. 3,997,114, 4,046,321 and 4,287,912 and U.S. Pat. No. Des. 239,048.

A need has existed for high pressure hot water acid wash systems in which water temperature and pressures are carefully controlled.

The present invention describes and claims improvements which simplify the apparatus and improve operation.

SUMMARY OF THE INVENTION

The invention provides an improved simplified high pressure hot water chemical washer apparatus and method.

The present invention controls water temperature by anticipating needs for heating and for stopping heating. The present invention controls water pressure maximums throughout the system immediately at locations where pressure increases are or may be generated. By so doing, the present invention assures controlled system pressures on system components and longevity of the washer with increased operations at maximum temperatures and pressures.

In using the method, a high pressure hot water acid washer is towed to a site on a trailer. A chemical tank and gasoline and diesel fuel tanks are filled. A water supply hose is connected to a water tank. A power cord is connected to a power source. A float valve controls the filling and maintaining of the water level in the water tank. Water flows from the water tank through a filter to a water pump. The water pump and a compressor are driven with a gasoline engine. Overpressure is released at the heat exchanger, enabling the pump to operate at maximum pressures during periods of maximum water flow without preaccounting for expected pressure spikes, on valve shutoff, for example. Pressurized water flows through a flow switch to a heat exchanger. The flow switch, upon sensing flow, completes a power circuit to operate a fuel pump with an electric motor, anticipating heating demands and stopping heating when flow is stopped, even for a short time, and permitting the heat exchanger to operate at high maximum temperatures. Fuel is pumped from the fuel tank and is vaporized and sprayed into the heat exchanger. An ignition coil ignites the fuel. The power circuit is interrupted upon sensing a high temperature in a pressurized water delivery line from the heat exchanger. Pressure of pressurized hot water in the delivery line is limited by a hot water pressure relief valve, enabling the operations of the system to be at maximum high pressures without undue stress of components. Pressurized hot water flows out through a high pressure hot water hose and nozzle. The chemical tank is pressurized with air from the compressor, which flows through a pressure relief valve and a unidirectional check valve. Chemical flows from the chemical tank under the influence of air pressure through a chemical line. Rate of flow of chemical is controlled with a needle valve. Opening the chemical line with a ball valve releases chemical to the fast hot water stream from the nozzle.

A high pressure hot water acid injection washer apparatus has a gasoline engine. A water pump and a compressor are driven by the engine. A water intake line is connected to the pump, and a Y-type water filter is mounted in the intake line. A water supply is connected to the intake line for supplying water through the filter to the pump. A drain connected to the pump drains water from the pump. A pressurized water outlet is connected to the pump. A bypass is connected to the outlet and is connected to the water supply for returning water from the outlet of the pump to the water supply upon lack of flow. A pressurized water flow line is connected to the outlet. A flow switch is mounted in the pressurized water flow line for sensing flow of water through the flow line. A heat exchanger is connected to the pressurized flow line for receiving water flowing through the pressurized water flow line and the flow switch.

A fuel pump and a burner are connected to a fuel tank and are operated by a motor connected to the flow switch for operating the pump and burner when the flow switch senses flow of water to the heat exchanger. A high pressure hot water delivery line is connected to the heat exchanger outlet port. A temperature sensor control is connected to the hot water delivery line and is connected to the pump motor and burner, for permitting operation of the pump and burner until a predetermined high temperature is sensed from the outlet port. A high pressure hot water delivery hose and a high pressure hot water nozzle are connected to a hot water pressure relief valve at an end of the delivery line for releasing excess pressure in the hot water line before reaching the delivery hose.

The filter supplies clean particle-free water to the pump. The entire construction may be built without excess materials. A bypass opens to release pump output pressures to the water tank, when flow through the heat exchanger and nozzle is stopped. A reducing-type pressure relief valve relieves overpressures, shocks and hammers which might be created by opening and closing valves, for example. The flow switch permits operation of the fuel pump and burner only when water is flowing from the pump to the heat exchanger. The aquastat prevents the excess heating of the water, which might result in the production of too hot pressurized water or water that might flash to steam upon being released.

The water supply includes a water tank having an inlet connection for a hose and having a float valve controlling the inlet. The water tank supplies water from a water source to the water filter and the water pump.

The compressor is connected to an air line, and the air line is connected to a chemical tank for pressurizing the chemical tank. A valve in the air line prevents air pressure and acid fumes from flowing from the acid tank back to the compressor. A chemical line is connected to the chemical tank for delivering chemical under influence of the air pressure. A needle valve is mounted in the chemical line for controlling flow of chemical through the chemical line. A ball valve is connected to the needle valve for opening and closing the chemical line. A chemical injector connected to the ball valve releases chemical into a hot water stream from a nozzle.

A preferred portable high pressure acid wash apparatus, has a trailer frame. An axle and wheels are mounted on the frame, and a tow hitch is connected to the frame for transporting the frame. A stand is connected to the frame near the tow hitch for supporting the frame when stationary.

A power circuit on the frame receives electrical power from a cord and a plug. A motor is coupled to the power circuit and connected to the fuel pump for driving the fuel pump and vaporizing and spraying fuel into the heat exchanger. An ignition coil is connected to the power circuit for igniting vaporized fuel in the heat exchanger. The flow switch is connected to the power circuit and to the motor and ignition coil and connected to the water pressure line for permitting operation of the motor and ignition coil upon sensing flow in the water pressure line.

A high temperature control is connected to the power circuit and to the pressurized hot water delivery line for permitting completion of the power circuit and operation of the pump and ignition coil upon sensing temperature below a predetermined level in the pressurized hot water delivery line.

These and further and other objects and features of the invention are apparent in the disclosure, which includes the above and ongoing written specification, with the claims and the drawings.

DETAILED DESCRIPTION OF THE DRAWINGS

Figure 1:
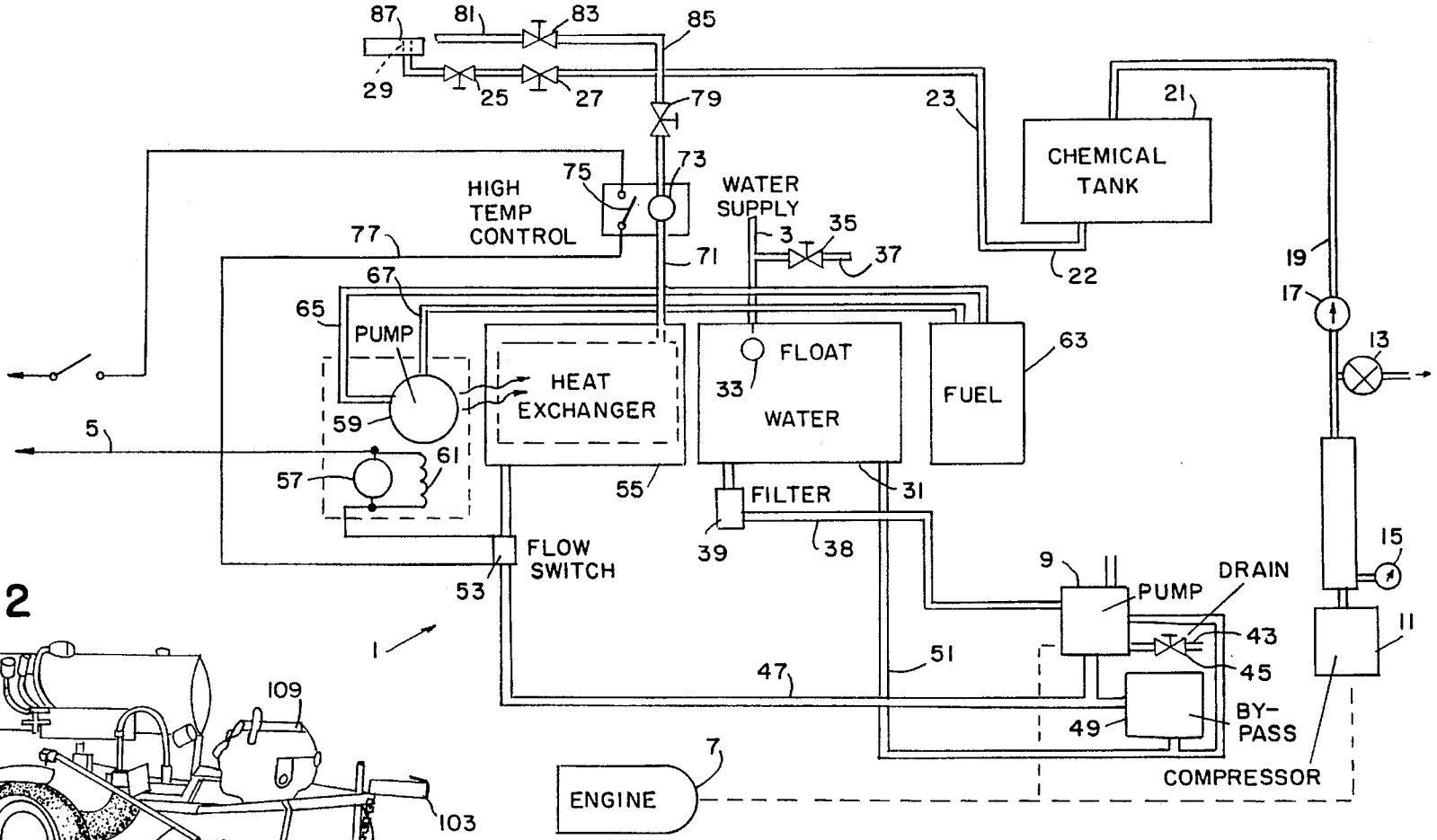
FIG. 1 is a schematic view of the high pressure hot water acid wash system the present invention.

Referring to FIG. 1, a high pressure hot water acid wash system is generally indicated by the numeral 1. The system is self-contained and it need only be connected to a water supply 3 with a conventional hose and to an electric power supply 5 of conventional power. A gasoline engine 7 drives a water pressure pump 9 and a small air compressor 11. The compressor delivers compressed air to an air pressure relief valve 13. The air pressure relief valve 13 prevents buildup of excess pressure from the compressor. A valve 17 stops air pressure and acid fumes from returning to the compressor 11. The valve 17 which stop pressure is called a mono-flow valve and is described in U.S. Pat. No. 4,287,912. Pressure gauge 15 indicates the pressure in the air line.

A check valve 17 in the air line 19 prevents reverse flow of air and chemical vapor back toward the compressor. Compressed air is delivered to the top of a chemical tank 21 to supply a small increased pressure to the chemical tank to deliver chemical, notably acid, over acid and chemical hose 23. The hose is turned on and off by a ball valve 25. A needle valve 27 controls rate of flow through the hose to a reducer 29, which releases a small jet of acid into a water stream.

Water tank 31 receives the water from a water supply 3 as controlled by a float valve 33, so that water in the tank is at atmospheric pressure and is independent of fluctuations in the water supply. A valve 35 and a coupling 37 provide an on-board connector for hoses. Water flows from tank 31 through an inlet line 38 and an external filter 39, which removes all particles from the water. A drain 43 controlled by a drain valve 45 is connected to the pump for draining water from the system after use and before transporting or storing the system in near-freezing conditions. Since the water pump runs at constant speed and since the inlet pressure is constant and small, the output of the pump is substantially constant. A bypass return is provided to return water to the water tank.

High pressure water line 47 is connected to the pump. Bypass 49 is connected to the high pressure water line 47 for flowing water to a return line 51 upon excess pressure from the pump, keeping the pressure in line 47 substantially constant. Pressurized water flows in line 47 through flow switch 53 to the heat exchanger 55. Flow switch 53 permits energization of electric motor 57, which drives fuel pump 59, and ignition coil 61, which ignites the fuel. When flow in line 47 stops, flow switch 53 turns off the motor 57 and the ignition coil 61.

Pump 59 pumps diesel fuel from storage tank 63. The fuel is delivered from the tank by line 65 and returns to the tank by line 67 to precisely control the spraying pressure of fuel pump 59. Pump 59 atomizes and sprays the fuel into the heat exchanger 55, and ignition coil 61 provides the high voltage, low energy arc to ignite the diesel fuel oil mist. Hot water flows out of the heat exchanger 55 through high pressure hot water delivery line 71. Temperature sensor 73 senses the temperature and switch 75 interrupts the power circuit 77 to cut off power to fuel pump motor 57 and to igniter 61 when the water is above a predetermined temperature in the hot water pressure delivery line 71. A pressure relief valve 79 releases excess pressure in the hot water pressurized delivery line. The pressure relief valve 79 operates to release surges that may occur transiently and to maintain pressure substantially constant in the output line. Excess pressure in the hose is prevented. The flow of pressurized hot water through the nozzle 81 is controlled by the valve 83 at the end of water hose 85. Valve 83 is preferably a lever operated valve in a pistol grip handle. Water and acid strike the shaping plate 87 and fan out in a controlled flat high pressure spray.

The pressure relief valve 79 ensures against unwanted pressure surges from the nozzle 81. The flow switch 53 prevents excessive heating of water in the heat exchanger 55 when flow stops in flow line 47.

The present invention improves the Hewett U.S. Pat. No. 3,997,114 patent system, which is commonly owned and assigned to the same assignee as the present invention, by preventing excess pressure in the high pressure hot water delivery line and hot water hose and nozzle, by insuring that the fuel pump and igniter operate and heat the heat exchanger only when water is flowing from the pump through the high pressure ambient temperature water line and through the heat exchanger.

The external water intake filter ensures particle removal from the water tank and prevents particle movement to the pump.

The drain on the pump drains the system without requiring separate draining of the water tank.

Figure 2:
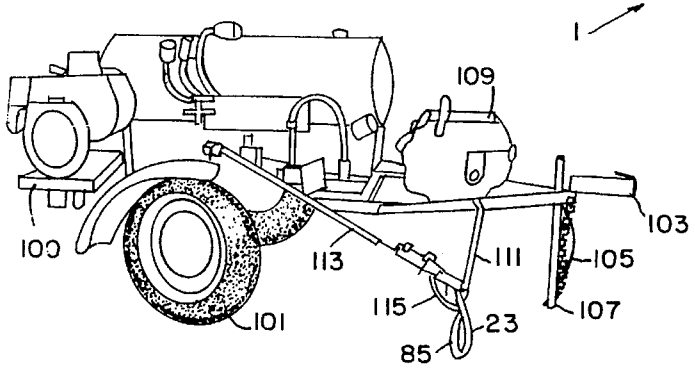
FIG. 2 is a schematic view of the system assembled on the over-the-road trailer.

As shown in FIG. 2, the entire system 1 is mounted on a frame 100, which is mounted on rubber tired wheels 101. Trailer hitch 103 and chain 105 are used for hauling the system over roadways into the precise position at a construction site or existing building. Stand 107 supports the frame 101 when unhitched. The acid and water hoses 23 and 85 are held together as a flexible unit 111. The nozzle wand 113 with a pistol grip 115 releases and mixes water and chemical at its distal end.

The system of the present invention has a discharge capacity of about 3.5 gallons per minute at an output pressure of about 2000 to 3000 psi maximum. The pressure relief valve in the pressurized hot water delivery line is a pressure-reducing type atmospheric relief valve, which unloads the system at pressures greater than approximately 50 psi over the set desired pressures.

The system uses a small quarter horsepower air compressor to deliver compressed air through a pressure relief valve and a check valve to a tank. Air drives the acid or chemical from the tank through a quarter inch acid and heat-resistant hose. The chemical or acid injection control uses an on/off ball valve at the pistol grip shutoff gun and a metering valve.

The water filter is a Y-type line strainer with a 6 inch length and an 80 mesh stainless steel screen.

The heat exchanger is made of a coil of one-half inch schedule 40 pipe around a cylindrical fire chamber. A Beckett AFG burner is fed by a small fuel pump coupled to a small electric motor. An igniter, which is conventional in small fuel oil water heaters, is used to ignite the vaporized fuel. The heat exchanger provides a minimum 100° F. rise over inlet water temperature.

The flow switch has a nylon housing and an encapsulated reed switch with tungsten bar and plate contacts and ⅜ inch inlet and outlet fittings.

An 11 to 18 horsepower gasoline engine is used. A gasoline storage tank provides 1.5 to 3.5 gallons. A diesel fuel tank stores about 9 gallons of diesel fuel, and an acid/chemical storage tank stores about 20 gallons of chemical. The water storage tank is about 7 gallons. 200 feet of water and chemical hoses are provided. The water hose is a ⅜" wire hose reinforced with a wire braid.

The heavy duty, over-the-road trailer and machine measure about 8½ feet long, 4½ feet wide and 4 feet high, and weight about 1300 to 1400 lbs.

Operation begins by towing the trailer to a site, filling the gasoline and diesel tanks and filling the chemical tank, connecting the power cord to a source of conventional electric power, and connecting a water hose to the water tank, closing a switch and starting the engine. The water trigger is then pulled, the ball valve is opened to release acid, and the acid flow is adjusted by the needle valve at the wand. Water continually fills the water tank. Water and chemical are delivered at rates and pressures controlled by the washer, irrespective of water main pressures. During interruptions, the ball valve is turned off to stop the acid flow, and the trigger valve is released. The system automatically stops heating the water, and the engine continues to run. Water is pumped back into the tank and is released from the pump pressure release on transient pressure surges.

The pressure relief valve at the machine end of the pressurized water hose releases any immediate output pressure spikes, such as caused by rapid closing of the trigger valve. The flow switch automatically stops the burner pump and igniter. When the trigger valve is reopened, the flow switch starts the burner pump and igniter, and the system automatically returns to normal.

When the system is shut down the engine is shut off. After closing the ball valve and releasing the trigger, the electrical system is turned off and is disconnected, and the water supply hose is disconnected. The water and acid delivery hoses are wound on the reel, and the system is ready for transporting to another location.

While the invention has been described with reference to specific embodiments, modifications and variations of the invention may be constructed without departing from the scope of the invention, which is defined in the following claims.

I claim:

1. A high pressure hot water acid injection washer, comprising an engine, a water pump connected to the engine, a compressor connected to the engine, a water intake connected to the pump, a water filter connected to the intake, a water supply connected to the filter for supplying water through the filter to the pump, a drain connected to the pump for draining water from the pump, a pressurized water flow line connected to the pump, a bypass connected to the flow line and connected to the water supply for returning water from the pump to the water supply, a flow switch connected to the flow line for sensing flow of water in the flow line, a heat exchanger connected to the flow line for receiving water flowing through the pressurized water flow line and the flow switch, a fuel source, a fuel pump and a burner connected to the fuel source and connected to the flow switch for operating the pump and burner when the flow switch senses flow of water to the heat exchanger, a high pressure hot water delivery line connected to the heat exchanger, a temperature control connected to the delivery line and connected to the fuel pump and burner for permitting operation of the pump and burner until a predetermined high temperature is sensed in the delivery line, a hot water pressure relief valve connected to the high pressure hot water delivery line, a high pressure hot water delivery hose connected to the delivery line, a nozzle connected to the hot water hose for releasing a hot water stream, wherein the hot water pressure relief valve is provided for releasing water above a predetermined pressure in the hot water delivery line before reaching the water delivery hose, wherein the filter is provided for supplying clean water to the pump, and wherein the flow switch is provided for permitting operation of the fuel pump and burner only when water is flowing from the pump to the heat exchanger.

2. The apparatus of claim 1, wherein the water supply comprises a water tank having an inlet with a connection for a hose and having a float valve controlling the inlet, wherein the water tank supplies water from a water source to the water filter and the water pump.

3. The apparatus of claim 2, further comprising an air line connected to the compressor, a chemical tank connected to the air line for pressurizing the chemical tank, and a chemical line connected to the chemical tank for delivering chemical under air pressure, a chemical hose connected to the chemical line, a needle valve connected to the chemical hose for controlling flow of chemical through the chemical hose, and a ball valve connected to the chemical hose for opening and closing the chemical hose, and a chemical release connected to the chemical hose for releasing chemical into a hot water stream from a nozzle.

4. A portable high pressure acid wash apparatus, comprising a trailer frame, wheels mounted on the frame, and a tow hitch connected to the frame for transporting the frame, a stand connected to the frame near the tow hitch for supporting the frame, an engine mounted on the frame, a compressor connected to the engine for compressing air, a chemical tank mounted on the frame for storing chemical, an air line connected between the compressor and the chemical tank for providing air pressure to the chemical tank, a chemical flow line connected to the chemical tank for flowing chemical from the chemical tank, a chemical hose connected to the chemical flow line, a needle valve connected to the chemical hose for controlling rate of flow through the chemical hose, a ball valve connected to the chemical hose for selectively shutting off and turning on the flow of chemical through the chemical hose, and a spray head connected to the chemical hose for releasing chemical into a water stream, a water tank mounted on the frame, a water supply connected to the water tank, and a float valve connected to the water tank for admitting water from the water supply to the water tank for maintaining water level in the water tank, a water outlet line connected to the tank, a water filter mounted in the water outlet line for filtering water flowing through the water outlet line, a water pump mounted on the frame and connected to the engine for driving the water pump and connected to the water outlet line for receiving water, a drain connected to the water pump for draining water from the water pump, a pressure outlet connected to the water pump, and a bypass connected to the pressure outlet and connected to the water tank for returning water from the water pump to the water tank, a pressure line connected to the pressure outlet, a heat exchanger connected to the pressure line for heating water in the heat exchanger, a pressurized hot water delivery line connected to the heat exchanger for delivering hot pressurized water from the heat exchanger, a hot water pressure relief valve connected to the pressurized hot water delivery line for relieving overpressure in the delivery line, a control valve connected to the delivery line and a nozzle connected to the control valve for directing pressurized hot water, a fuel tank mounted on the frame, a fuel line connected to the fuel tank and a fuel pump connected to the fuel line, a power circuit on the frame for receiving electrical power, a motor connected to the power circuit and connected to the fuel pump for driving the fuel pump and atomizing fuel into the heat exchanger, an ignition coil connected to the power circuit for igniting vaporized fuel in the heat exchanger, a flow switch connected to the power circuit and to the motor and ignition coil and connected to the water pressure line for permitting operation of the motor and ignition coil upon water flow in the pressure line, a high temperature control connected to the power circuit and to the pressurized hot water delivery line for permitting completion of the power circuit and operation of the pump and ignition coil upon sensing temperature below a predetermined value in the pressurized hot water delivery line.

5. The method of high pressure hot water acid washing, comprising towing a washer to a site on a trailer, filling a chemical tank and a fuel tank, connecting a water supply to a water tank, connecting a power circuit to an electrical power source, controlling filling of the water tank with a float valve, flowing water from the water tank through a filter to a water pump, driving the water pump and a compressor with an engine, releasing overpressure from the pump, pumping water from the pump through a flow switch to a heat exchanger, completing the power circuit with the flow switch upon water flow, operating a fuel pump with an electric motor connected to the power circuit and pumping fuel from the fuel tank and spraying the fuel into the heat exchanger, energizing an ignition coil with the power circuit, igniting fuel with the ignition coil, interrupting the power circuit upon sensing a high temperature in a pressurized water delivery line from the heat exchanger, releasing pressure of pressurized hot water in the delivery line with a hot water pressure relief valve, and flowing pressurized hot water through a high pressure hot water hose and releasing a hot water stream from a nozzle, pressurizing the chemical tank with air from the compressor and flowing chemical out from the chemical tank through a chemical line and through a needle valve and controlling rate of flow of chemical with the needle valve, opening the chemical line with a ball valve and releasing chemical to the hot water stream from the nozzle.

* * * * *